US011448451B2

(12) United States Patent
Cheng et al.

(10) Patent No.: US 11,448,451 B2
(45) Date of Patent: Sep. 20, 2022

(54) AIR-COOLED REFRIGERATOR

(71) Applicants: HAIER SMART HOME CO., LTD., Shandong (CN); QINGDAO HAIER REFRIGERATOR CO., LTD, Shandong (CN)

(72) Inventors: Xueli Cheng, Qingdao (CN); Bin Fei, Qingdao (CN); Dengqiang Li, Qingdao (CN); Chunyang Li, Qingdao (CN); Lisheng Ji, Qingdao (CN); Xiaobing Zhu, Qingdao (CN)

(73) Assignees: HAIER SMART HOME CO., LTD., Shandong (CN); QINGDAO HAIER REFRIGERATOR CO., LTD, Shandong (CN)

( * ) Notice: Subject to any disclaimer, the term of this patent is extended or adjusted under 35 U.S.C. 154(b) by 0 days.

(21) Appl. No.: 17/255,873

(22) PCT Filed: Dec. 14, 2018

(86) PCT No.: PCT/CN2018/121314
§ 371 (c)(1),
(2) Date: Dec. 23, 2020

(87) PCT Pub. No.: WO2020/000929
PCT Pub. Date: Jan. 2, 2020

(65) Prior Publication Data

US 2021/0262720 A1 Aug. 26, 2021

(30) Foreign Application Priority Data

Jun. 27, 2018 (CN) ..... 201810680804.9

(51) Int. Cl.
*F25D 17/04* (2006.01)
*F25D 11/02* (2006.01)
(Continued)

(52) U.S. Cl.
CPC ..... *F25D 17/045* (2013.01); *F25D 11/02* (2013.01); *F25D 17/065* (2013.01); *F25D 17/08* (2013.01);
(Continued)

(58) Field of Classification Search
CPC ..... F25D 17/045; F25D 11/02; F25D 17/065; F25D 17/08; F25D 21/14; F25D 2317/0671; F25D 2317/0683; F25D 2321/142
See application file for complete search history.

(56) References Cited

U.S. PATENT DOCUMENTS

2009/0178429 A1 7/2009 Lee et al.

FOREIGN PATENT DOCUMENTS

CN 102692110 A 9/2012
CN 102927743 A 2/2013
(Continued)

OTHER PUBLICATIONS

Translated_Liu (Year: 2017).*
(Continued)

*Primary Examiner* — Elizabeth J Martin
*Assistant Examiner* — Samba Nmn Gaye
(74) *Attorney, Agent, or Firm* — Alston & Bird LLP

(57) ABSTRACT

An air-cooled refrigerator includes an air duct assembly and an air door shielding device. The air duct assembly is provided with an accommodating cavity with a rearward air inlet. A plurality of air supply communicating holes are formed in a peripheral wall of the accommodating cavity. The air door shielding device is provided with a shielding part. The shielding part is provided with a plurality of air baffles. The shielding part is rotatably in the accommodating cavity, so as to have shielding positions for the plurality of air baffles to completely shield all of the air supply com-
(Continued)

municating holes. A bottom of a sidewall of the accommodating cavity is provided with a water guide groove inclined rearward and downward. The air duct assembly is provided with a water outlet hole communicating a rear side of the air duct assembly with a rear end of the water guide groove, so that water in the accommodating cavity flows out of the air duct assembly by means of the water guide groove.

13 Claims, 5 Drawing Sheets

(51) Int. Cl.
*F25D 17/06* (2006.01)
*F25D 17/08* (2006.01)
*F25D 21/14* (2006.01)

(52) U.S. Cl.
CPC ..... *F25D 21/14* (2013.01); *F25D 2317/0671* (2013.01); *F25D 2317/0683* (2013.01); *F25D 2321/142* (2013.01)

(56) References Cited

FOREIGN PATENT DOCUMENTS

| | | | | | |
|---|---|---|---|---|---|
| CN | 106196832 | A | | 12/2016 | |
| CN | 106196834 | A | * | 12/2016 | ..... F25D 17/045 |
| CN | 106885427 | A | * | 6/2017 | |
| CN | 206300403 | U | * | 7/2017 | |
| CN | 206300403 | U | | 7/2017 | |
| CN | 107270618 | A | | 10/2017 | |
| CN | 108759245 | A | | 11/2018 | |
| EP | 2273217 | A2 | | 1/2011 | |
| WO | WO-2017049961 | A | * | 3/2017 | ..... F25D 17/045 |
| WO | WO 2018/108054 | A1 | | 6/2018 | |
| WO | WO-2018108054 | A1 | * | 6/2018 | ..... F25D 17/065 |

OTHER PUBLICATIONS

Translated_shanmu (Year: 2018).*
Translated_Qu (Year: 2017).*
Translated_Tao (Year: 2016).*
Translated_Ding (Year: 2017).*
1st Office Action for EP Application No. 18925040.0 dated Jul. 28, 2021 (8 pages).
Extended European Search Report for EP Application No. 18925040.0 dated Jul. 16, 2021 (4 pages).
Written Opinion for PCT/CN2018/121314 dated Mar. 18, 2019 (5 pages).
International Search Report (ISA/CN) for PCT/CN2018/121314, dated Mar. 18, 2019 with English translation (7 pages).
Written Opinion for PCT/CN2018/121314 dated Mar. 18, 2019.
2nd Office Action for EP Application No. 18925040.0 dated Dec. 20, 2021 (7 pages).

* cited by examiner

AIR-COOLED REFRIGERATOR

CROSS-REFERENCE TO RELATED APPLICATIONS

The present application is a national phase entry of International Application No. PCT/CN2018/121314, filed Dec. 14, 2018, which claims priority to Chinese Patent Application No. 201810680804.9, filed Jun. 27, 2018, which are incorporated herein by reference in their entirety.

FIELD OF THE INVENTION

The present invention relates to the technical field of freezing and refrigeration, and more particularly relates to an air-cooled refrigerator.

BACKGROUND OF THE INVENTION

The air-cooled refrigerator can keep food fresh, preserve the storage time of food, and improve food safety, and is an essential household appliance. However, for the current air-cooled refrigerators on the market, during defrosting, as the temperature of a heating wire rises, hot air flows directly from an air duct opening to a freezing compartment by convection, causing food surface temperature to rise, and accelerating food deterioration. At the same time, the temperature of the freezing compartment rises, which increases the next refrigerating time and power consumption. In order to prevent hot air from entering a storage compartment directly, a lift type shielding cover is generally disposed on an axial flow fan at an air outlet of a cellar compartment. The fan and the air outlet of the cellar compartment are covered with the cover vertically when defrosting and shielding are needed, and during air supply, the cover is opened vertically to expose the axial flow fan and the air outlet of the cellar compartment. Such design has the problems that the occupied space is too large, and the cover is easy to freeze and fail. Specifically, an existing fan for the shielding technology is large in volume, and during defrosting, defrosting water on the fan easily flows to a gap between a moving component and a fixed part, is not easy to discharge, and is easy to freeze.

BRIEF DESCRIPTION OF THE INVENTION

The present invention aims to overcome at least one defect of an existing air-cooled refrigerator, and provides a novel air-cooled refrigerator with a compact structure, convenient water discharge of an air duct opening and closing device and no freezing phenomenon.

Specifically, the present invention provides an air-cooled refrigerator, including a cabinet. The cabinet is provided with a cellar compartment, at least one storage compartment, and an air duct assembly communicating the cellar compartment and the at least one storage compartment. In particular, the air duct assembly is provided with an accommodating cavity with a rearward air inlet, and a plurality of air supply communicating holes are formed in a peripheral wall of the accommodating cavity. Air in the cellar compartment enters the at least one storage compartment via the plurality of air supply communicating holes.

The air-cooled refrigerator further includes an air door shielding device. The air door shielding device is provided with a shielding part, and the shielding part is provided with a plurality of air baffles. The shielding part is rotatably disposed in the accommodating cavity, so as to have shielding positions for the plurality of air baffles to completely shield all the air supply communicating holes, thus further preventing the air in the cellar compartment from entering the at least one storage compartment via the plurality of air supply communicating holes during the defrosting of the air-cooled refrigerator.

A bottom of a sidewall of the accommodating cavity is provided with a water guide groove inclined rearward and downward, and the air duct assembly is provided with a water outlet hole communicating a rear side of the air duct assembly with a rear end of the water guide groove, so that water in the accommodating cavity flows out of the air duct assembly via the water guide groove and the water outlet hole.

Optionally, the air duct assembly includes a first air duct portion.

The accommodating cavity is disposed in an upper part of the first air duct portion.

A middle part and/or a lower part of a rear surface of the first air duct portion are/is recessed forward, and a rear side of the first air duct portion is the cellar compartment. A front side of the first air duct portion is one or more of the storage compartments.

Optionally, the air door shielding device further includes a centrifugal wind wheel mounted within the accommodating cavity and configured to draw an airflow from the air inlet and urge the airflow to enter each of the air supply communicating holes in a circumferential direction and/or radial direction thereof.

Optionally, the air door shielding device further includes:

a base, wherein the shielding part is further provided with a turntable portion rotatably mounted on the base; the plurality of air baffles extend from the turntable portion to a rear side, and are disposed at intervals in a circumferential direction of the turntable portion; and the centrifugal wind wheel is mounted on the base;

a motor, disposed on a radial outer side of the shielding part, and mounted on the base;

a driving gear, mounted on an output shaft of the motor; and a driven gear, mounted on the turntable portion or integrally formed with the turntable portion, and meshed with the driving gear.

Optionally, the turntable portion is a rotating ring. The driven gear is a gear ring disposed on the side of the turntable portion facing away from the air baffle.

The base includes a base plate, a bottom cover, and a first position baffle extending from one side of the base plate. The centrifugal wind wheel is mounted on the other side of the base plate.

The turntable portion is mounted on a radial outer side of the first position baffle, and each of the air baffles extends out of the other side of the base plate.

The bottom cover covers the side of the base plate, and covers at least the side of the turntable portion facing away from the air baffle. The inner side of the bottom cover is provided with a second position baffle and a third position baffle. The gear ring is disposed on a radial outer side of the second position baffle and a radial inner side of the third position baffle.

Optionally, the second position baffle is provided with a notch.

The side of the turntable portion facing away from the air baffle is further provided with a bump disposed within the notch to define a rotating range of the turntable portion.

The side of the turntable portion facing the base plate is provided with an annular rib.

The side of an edge of the base plate facing the turntable portion is an inclined surface.

Optionally, the base further includes a motor mounting portion and a spanning plate. The spanning plate includes:

a first avoiding plate, extending from an edge of the base plate in a direction away from the base plate;

a second avoiding plate, disposed in parallel with the first avoiding plate, and located on a radial outer side of the air baffle; and a connecting plate, connecting the first avoiding plate and the second avoiding plate, and allowing one or more of the air baffles to enter between the first avoiding plate and the second avoiding plate.

The motor mounting portion is disposed on the side of the second avoiding plate back away from the first avoiding plate. The motor is mounted on the motor mounting portion. The bottom cover further covers the motor mounting portion.

Optionally, the first air duct portion includes:

a rear cover plate, wherein the rear cover plate is provided with a back plate and a cavity defining plate extending from the back plate; the air inlet is formed in an upper part of the back plate; the cavity defining plate defines the accommodating cavity, the plurality of air supply communicating holes, and air supply ducts respectively with the plurality of air supply communicating holes, and the air supply ducts include at least one first air supply duct;

a middle plate, disposed on a front side of the back plate, and being in contact with and abutted against the cavity defining plate; and a front cover plate, covering the rear cover plate, and having a front plate located on a front side of the middle plate and a plurality of air supply structures formed on the front plate.

The middle plate is arranged such that each of the first air supply ducts is communicated with one or more of the air supply structures via the middle plate.

Optionally, the air duct assembly includes a second air duct portion, the second air duct portion is located on an upper side of the first air duct portion, and a front side of the second air duct portion is one or more of the storage compartments.

The air supply duct further includes a second air supply duct, and an upper surface of the first air duct portion is provided with a communicating air opening communicating the second air supply duct and the second air duct portion.

Optionally, the number of the air supply communicating holes is four, including a first communicating hole, a second communicating hole, a third communicating hole, and a fourth communicating hole formed in sequence clockwise. The first communicating hole is formed in an upper right side of the accommodating cavity, and the second communicating hole is formed in a lower right side of the accommodating cavity. The third communicating hole and the fourth communicating hole are connected to each other and formed in a left side of the accommodating cavity.

The second air supply duct extends rearward and upward from the first communicating hole to the communicating air opening.

The number of the first air supply ducts is three, including an air supply duct I, an air supply duct II, and an air supply duct III.

The air supply duct I is provided with a main air duct connected to the second communicating hole, an upper branch extending upward from a tail end of the main air duct, and a lower branch extending downward from the tail end of the main air duct.

The air supply duct II extends downward from the third communicating hole.

The air supply duct III extends upward from the fourth communicating hole.

The number of the air baffles is three, including a first air baffle, a second air baffle, and a third air baffle disposed in sequence clockwise. The first air baffle is configured to completely shield the first communicating hole. The second air baffle is configured to completely shield the second communicating hole. The third air baffle is configured to completely shield the third communicating hole and the fourth communicating hole.

The air-cooled refrigerator of the present invention has the air door shielding device which adopts a rotary structure and is simple and compact in structure and convenient to control. Furthermore, a special defrosting water discharge channel is disposed, so that condensate water at the air door shielding device can be smoothly discharged. Further, the air duct can be shielded during the defrosting of the refrigerator, thereby preventing the airflow of elevated temperatures from entering the storage compartment, which can provide best storage environments for food, reduce nutrition loss of food, and improve the freezing preservation performance of the air-cooled refrigerator. Furthermore, the power consumption of the refrigerator can be reduced, and energy can be saved.

Further, an ingenious structure is disposed between components of the air door shielding device, so that defrosting water can be smoothly discharged, and is prevented from accumulating at the air door shielding device to cause the air door shielding device to freeze and fail. Furthermore, the air door shielding device can save space and increase the volume of a freezer compartment of the refrigerator.

The above and other objectives, advantages and features of the present invention will become more apparent to those skilled in the art from the following detailed description of specific embodiments of the present invention in conjunction with the accompanying drawings.

BRIEF DESCRIPTION OF THE DRAWINGS

Some specific embodiments of the present invention will be described in detail hereinafter in way of example and not by way of limitation with reference to the accompanying drawings. The same reference numerals in the drawings indicate the same or similar components or parts. It should be understood by those skilled in the art that these drawings are not necessarily drawn to scale. In the drawings.

DETAILED DESCRIPTION

Figure 1:
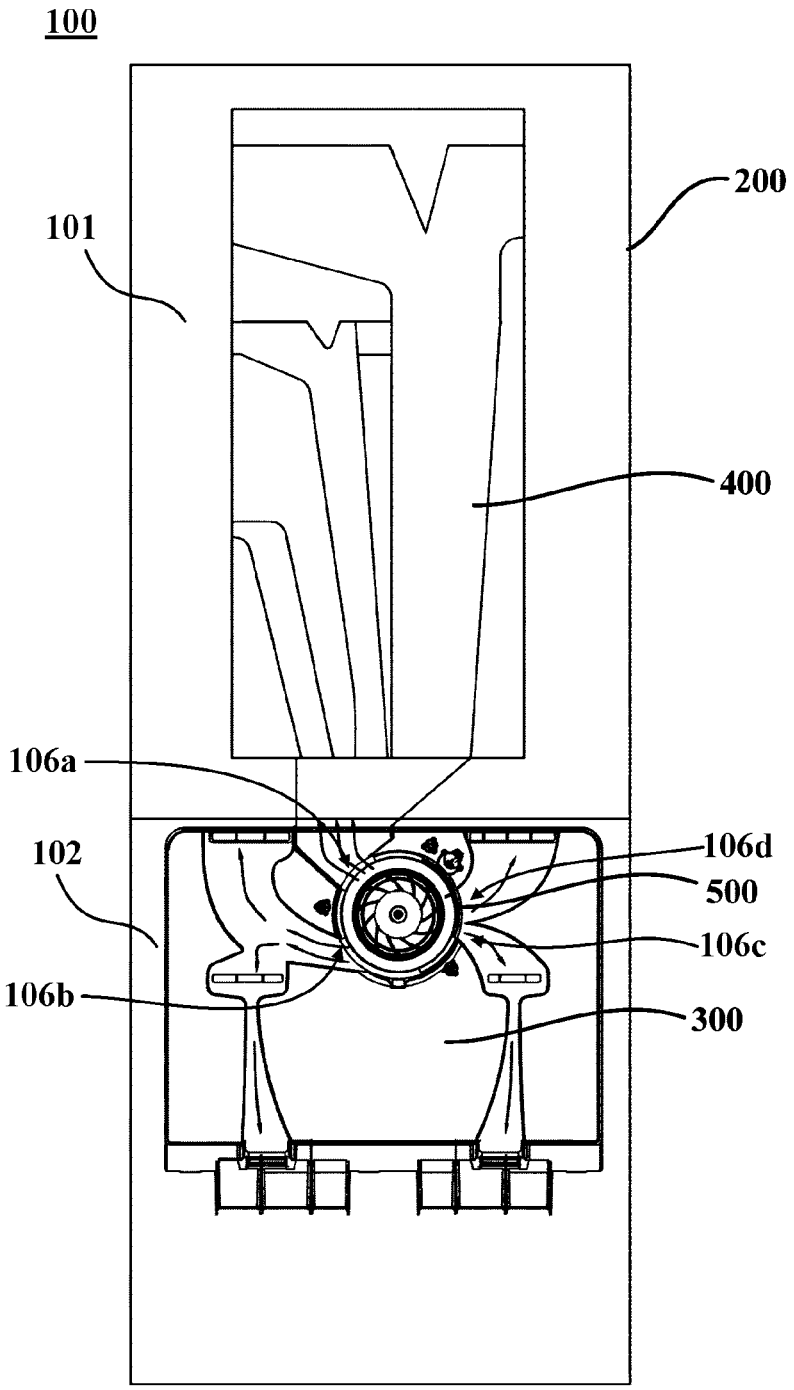
FIG. 1 is a schematic structural view of an air-cooled refrigerator according to one embodiment of the present invention.

FIG. 1 is a schematic structural view of an air-cooled refrigerator according to one embodiment of the present invention, which may be shown in a direction from the rear side of the air-cooled refrigerator to front, and arrows in the figure may represent an airflow direction. As shown in FIG. 1 and with reference to FIG. 2 to FIG. 6, the embodiment of the present invention provides the air-cooled refrigerator 100, including a cabinet 200. The refrigerator 200 is provided with a cellar compartment 102, at least one storage compartment 101, an air duct assembly (300, 400) communicating the cellar compartment and the at least one storage compartment, and an air door shielding device 500. The air duct assembly may be provided with an accommodating cavity 105 with a rearward air inlet 104, and a plurality of air supply communicating holes 106 are formed in a peripheral wall of the accommodating cavity. Air in the cellar compartment enters the at least one storage compartment via the plurality of air supply communicating holes.

The air door shielding device 500 may include a shielding part 520. The shielding part 520 is provided with a plurality of air baffles 521. The shielding part 520 is rotatably disposed in the accommodating cavity, so as to have shielding positions for the plurality of air baffles 521 to completely shield all the air supply communicating holes, thus further preventing the air in the cellar compartment from entering the at least one storage compartment via the plurality of air supply communicating holes during the defrosting of the air-cooled refrigerator. Specifically, during the defrosting of the air-cooled refrigerator, the air baffle 521 can be rotated to the shielding positions enclosing the air supply communicating holes, and during normal air supply of the air-cooled refrigerator, the air baffle 521 can be rotated to normal positions completely exposing all the air supply communicating holes. According to the embodiment of the present invention, by using the air baffles 521 which are rotatably disposed, the air baffles 521 can be rotated to the shielding positions enclosing the air supply communicating holes and also can be rotated to the normal positions completely exposing the air supply communicating holes, so as to realize normal air supply. A rotary structure is adopted, so that the volume of the air door shielding device 500 is reduced, the structure is simple and compact, and the control is convenient.

Further, a bottom of a sidewall of the accommodating cavity is provided with a water guide groove 381 inclined rearward and downward, and the air duct assembly is provided with a water outlet hole 382 communicating a rear side of the air duct assembly with a rear end of the water guide groove 381, so that water in the accommodating cavity flows out of the air duct assembly via the water guide groove 381 and the water outlet hole 382. The bottom of the sidewall of the accommodating cavity may also be inclined downward from front to back, so as to facilitate accumulation of water entering the accommodating cavity within the accommodating cavity, facilitate the discharge of water within the accommodating cavity and on the air door shielding device 500, and prevent the air door shielding device 500 from freezing and failing.

Figure 4:
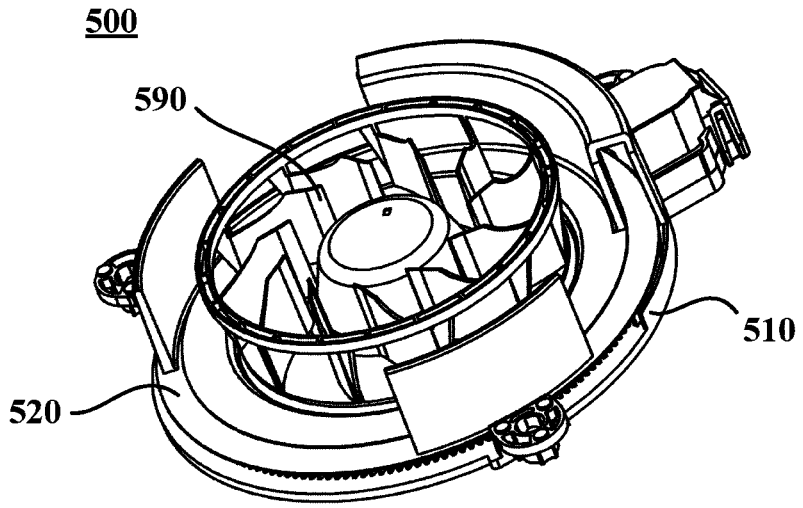
FIG. 4 is a schematic structural view of an air door shielding device in the air-cooled refrigerator shown in FIG. 1.
Figure 5:
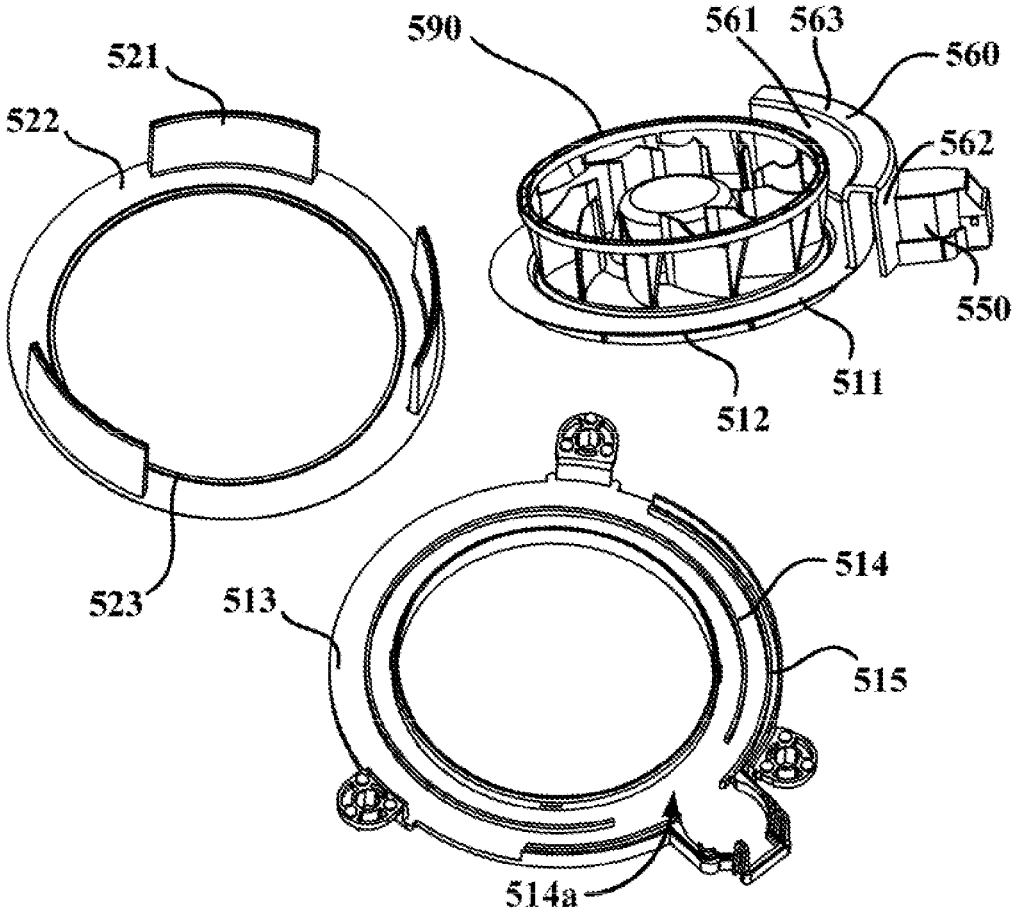
FIG. 5 is a schematic exploded view of the air door shielding device shown in FIG. 4.
Figure 6:
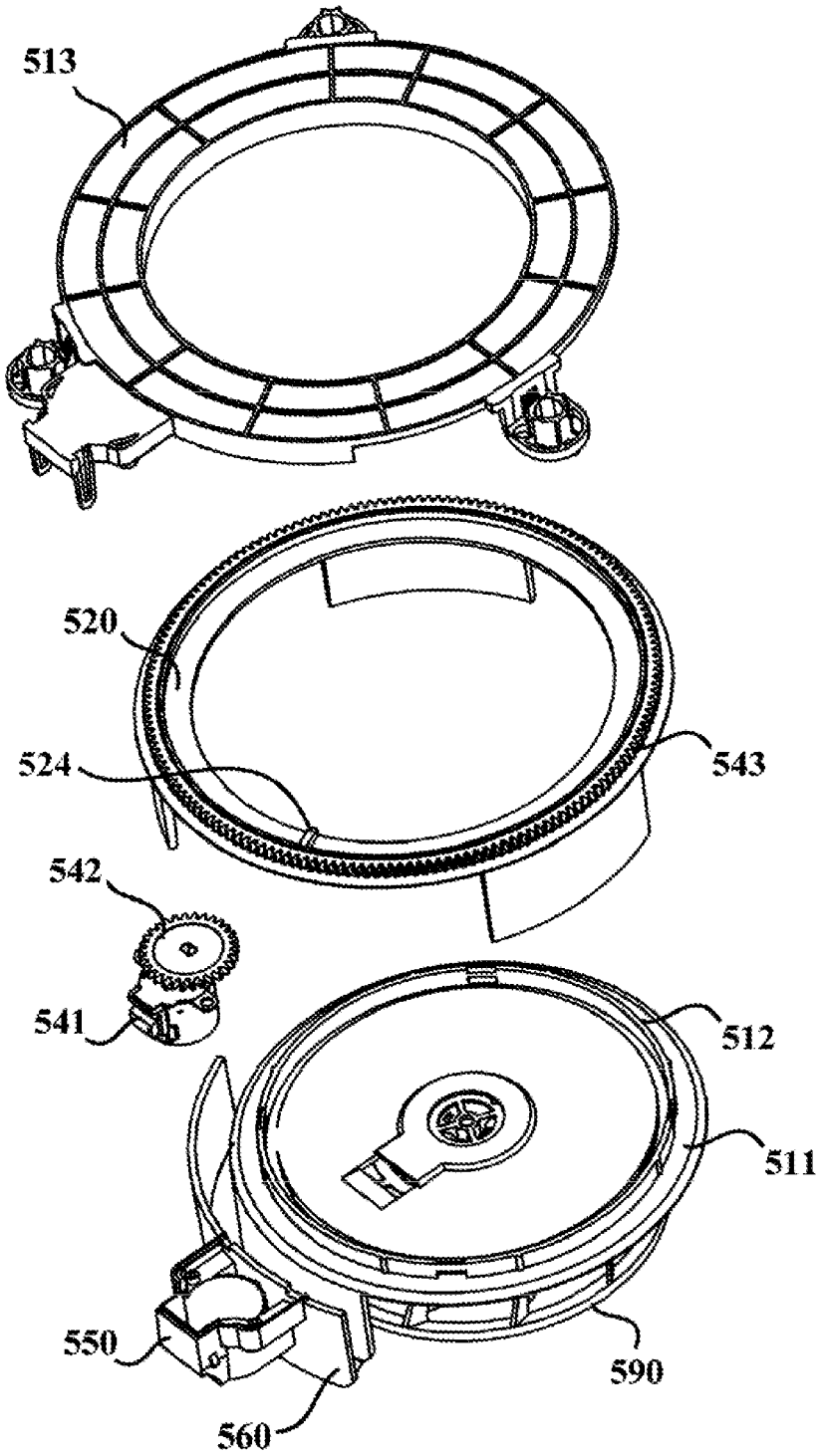
FIG. 6 is a schematic exploded view of the air door shielding device shown in FIG. 4 from another perspective.

In some embodiments of the present invention, as shown in FIG. 4 to FIG. 6, the air door shielding device 500 may further include a base 510. The base 510 may be disposed vertically. The shielding part 520 may be further provided with a turntable portion 522 mounted on the base 510. The plurality of air baffles 521 extend from the turntable portion 522 to one side of the turntable portion 522, and are disposed at intervals in a circumferential direction of the turntable portion 522.

Specifically, the turntable portion 522 is a rotating ring. The base 510 includes a base plate 511, a bottom cover 513, and a first position baffle 512 extending from one side of the base plate 511. The turntable portion 522 is mounted on a radial outer side of the first position baffle 512, and each of the air baffles 521 extends out of the other side of the base plate 511. The bottom cover 513 covers one side of the base plate 511, and covers at least the side of the turntable portion 522 facing away from the air baffle 521. Further, the bottom cover 513 may be clamped to the base plate 511, for example, to the side of the first position baffle 512 back away from the rotating ring. Part or all of the regions of the base plate 511 located on the inner side of the first position baffle 512 may be recessed toward the bottom cover 513. The base plate 511 may be disposed vertically, and is located on a front part of the accommodating cavity. The base plate 511 disposed vertically and other structures of the air door shielding device 500 can prevent water from accumulating and remaining among various components, so that defrosting water can be smoothly discharged.

In order to prevent the defrosting water moving to the accommodating cavity from accumulating within the accommodating cavity, entering and accumulating between various components of the air door shielding device 500, and freezing the air door shielding device 500, the side of the turntable portion 522 facing the base plate 511 is provided with an annular rib 523 which may be in contact with and abutted against the base plate 511. The side of an edge of the base plate 511 facing the turntable portion 522 is an inclined surface, so that an outward opening structure is formed between the turntable portion 522 and the base plate 511.

In some embodiments of the present invention, in order to facilitate the rotation of the shielding part 520, the air door shielding device 500 may further include a motor 541, a driving gear 542, and a driven gear 543. The motor 541 is disposed on a radial outer side of the shielding part 520, and mounted on the base 510. The driving gear 542 is mounted on an output shaft of the motor 541. The driven gear 543 may be mounted on the turntable portion 522 or integrally formed with the turntable portion 522, and meshed with the driving gear 542. Disposing the motor 541 on the radial outer side of the shielding part 520 can significantly reduce the overall thickness of the air door shielding device 500, and is particularly suitable for refrigerators. In some alternative embodiments, other transmission types may be adopted, for example, belt transmission, chain transmission, gear and rack transmission, and the like, and the shielding part 520 may also be directly mounted on the output shaft of the motor 541.

In some preferred embodiments of the present invention, the driven gear 543 is a gear ring disposed on the side of the turntable portion 522 facing away from the air baffle 521. The inner side of the bottom cover 513 is provided with a second position baffle 514 and a third position baffle 515. The gear ring is disposed on a radial outer side of the second position baffle 514 and a radial inner side of the third position baffle 515. The lengths of the first position baffle 512, the second position baffle 514, and the third position baffle 515 in a circumferential direction of the base 510 may be determined according to the demand.

Further, the second position baffle 514 is provided with a notch **514*a*. The side of the turntable portion 522 facing away from the air baffle 521 is further provided with a bump 524 disposed within the notch 514*a* to define a rotating range of the turntable portion 522**.

In some embodiments of the present invention, the base 510 further includes a motor mounting portion 550 and a spanning plate 560. The spanning plate 560 includes: a first avoiding plate 561, extending from an edge of the base plate 511 in a direction away from the base plate 511; a second avoiding plate 562, disposed in parallel with the first avoiding plate, and located on a radial outer side of the air baffle 521; and a connecting plate 563, connecting the first avoiding plate and the second avoiding plate, and allowing one or more of the air baffles 521 to enter between the first avoiding plate and the second avoiding plate. The motor mounting portion 550 is disposed on the side of the second avoiding plate back away from the first avoiding plate. The motor 541 is mounted on the motor mounting portion 550. The bottom cover 513 further covers the motor mounting portion 550.

In some embodiments of the present invention, in order to facilitate the flowing of an airflow, the air door shielding device 500 further includes a centrifugal wind wheel 590 mounted on the base plate 511, located on a radial inner side of the air baffles 521, and configured to urge the airflow to enter each of the air supply communicating holes in a circumferential direction and/or radial direction thereof. The centrifugal wind wheel 590 may be directly used as a fan at an air outlet of the cellar compartment of the air-cooled refrigerator, which makes the structure of the air-cooled refrigerator compact. In some other embodiments of the present invention, without the base 510, the centrifugal wind wheel 590 is also directly disposed within the accommodating cavity and mounted on the air duct assembly.

In some embodiments of the present invention, the air duct assembly may include a first air duct portion 300. The accommodating cavity is disposed in an upper part of the first air duct portion 300. A middle part and/or a lower part of a rear surface of the first air duct portion 300 are/is recessed forward, and a rear side of the first air duct portion 300 is the cellar compartment. A front side of the first air duct portion 300 is one or more of the storage compartments. Water in the accommodating cavity may directly enter the cellar compartment, and be discharged from the cellar compartment with a defrosting water discharge mechanism disposed at a bottom of the cellar compartment. The centrifugal wind wheel 590 of the air door shielding device 500 may draw the airflow from the air inlet, and urge the airflow to enter each of the air supply communicating holes in the circumferential direction and/or radial direction thereof. Through such arrangement, the structure of the air-cooled refrigerator can be compact, the layout can be reasonable, and the mounting and assembly can be convenient.

Figure 2:
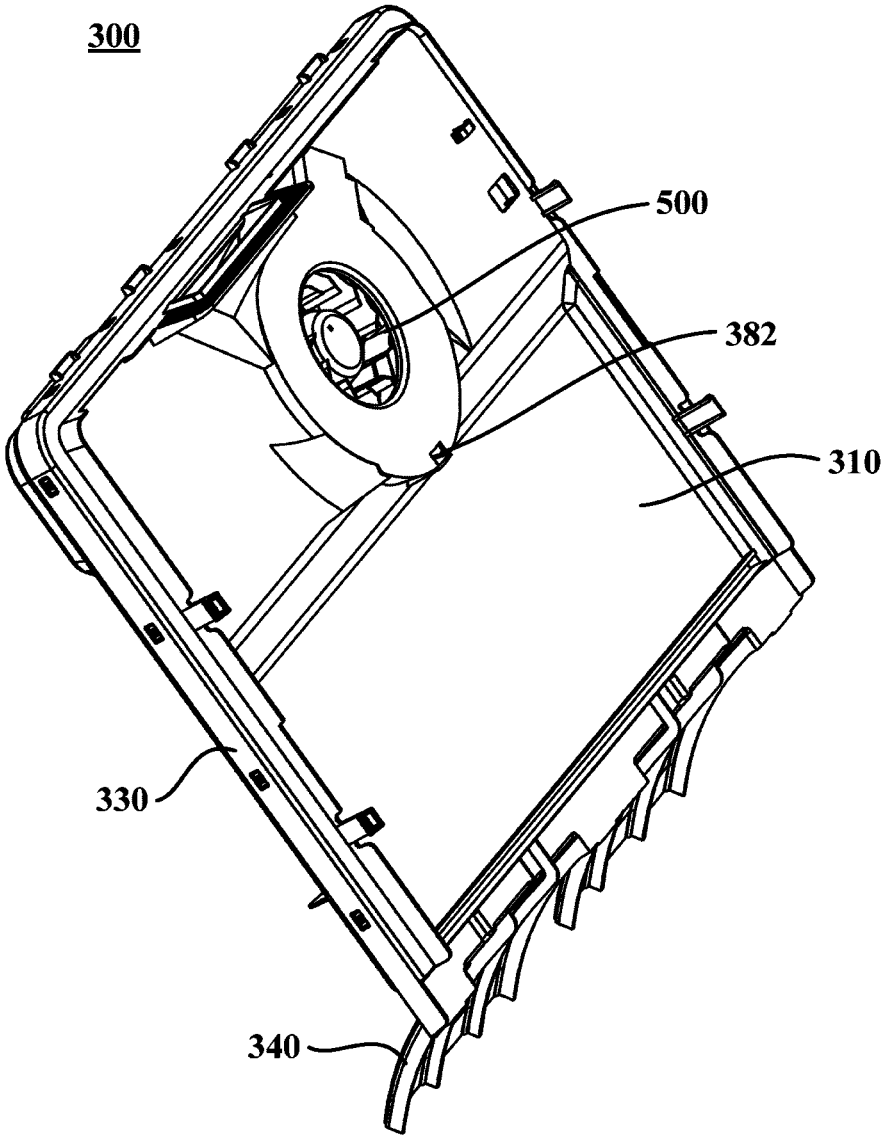
FIG. 2 is a schematic structural view of a first air duct portion in the air-cooled refrigerator shown in FIG. 1.
Figure 3:
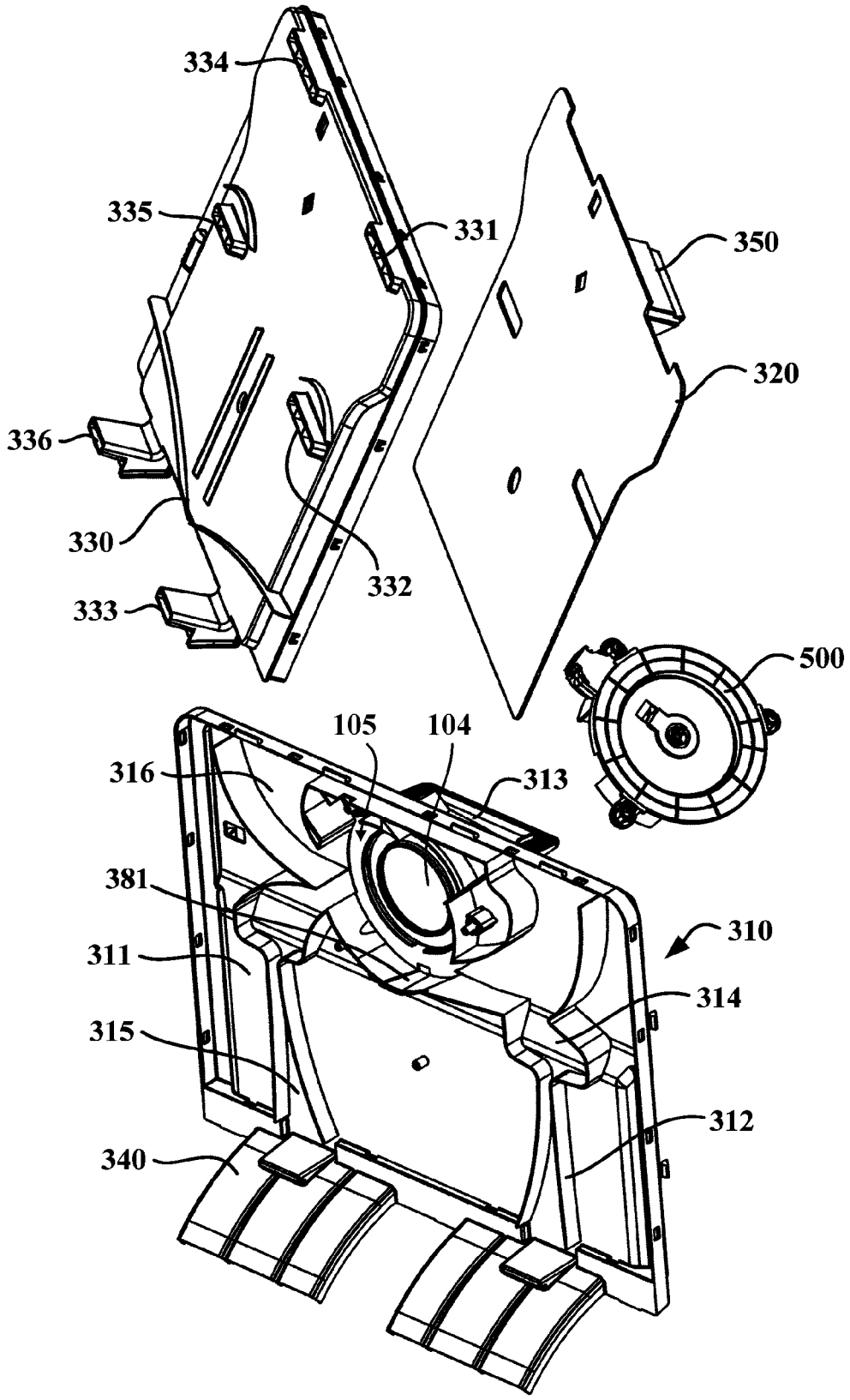
FIG. 3 is a schematic exploded view of the first air duct portion shown in FIG. 2.

In some embodiments of the present invention, as shown in FIG. 2 and FIG. 3, the first air duct portion 300 may include a rear cover plate 310, a middle plate 320, and a front cover plate 330. The rear cover plate 310 is provided with a back plate 311 and a cavity defining plate 312 extending from the back plate 311. The air inlet is formed in an upper part of the back plate 311. The cavity defining plate 312 defines the accommodating cavity, a plurality of air supply communicating holes, and air supply ducts respectively communicated with the plurality of air supply communicating holes, and the air supply ducts include at least one first air supply duct. The middle plate 320 is disposed on a front side of the back plate 311, and is in contact with and abutted against the cavity defining plate 312. The front cover plate 330 covers the rear cover plate 310, and the front cover plate 330 is provided with a front plate located on a front side of the middle plate 320 and a plurality of air supply structures formed on the front plate. The middle plate 320 is arranged such that each of the first air supply ducts is communicated with one or more of the air supply structures therethrough. Specifically, the middle plate 320 may be provided with structures such as notches or holes, so that the airflow within the first air supply duct enters the corresponding air supply structure. The air supply structures may be air supply openings, short air supply pipes, etc.

Further, the air duct assembly includes a second air duct portion 400. The second air duct portion 400 is located on an upper side of the first air duct portion 300, and a front side of the second air duct portion 400 is one or more of the storage compartments. The air supply duct further includes a second air supply duct 313, and an upper surface of the first air duct portion 300 is provided with a communicating air opening communicating the second air supply duct 313 and the second air duct portion 400. The storage compartment on the front side of the first air duct portion 300 may be a freezer compartment, and the storage compartment on the front side of the second air duct portion 400 may be a fresh-food compartment.

In some more specific embodiments of the present invention, with reference to a mirror image view shown in FIG. 1, the number of the air supply communicating holes 106 is four, including a first communicating hole 106*a*, a second communicating hole 106*b*, a third communicating hole 106*c*, and a fourth communicating hole 106*d* formed in sequence clockwise. The first communicating hole is formed in an upper right side of the accommodating cavity, and the second communicating hole is formed in a lower right side of the accommodating cavity. The third communicating hole and the fourth communicating hole are connected to each other and formed in a left side of the accommodating cavity.

The second air supply duct 313 extends rearward and upward from the first communicating hole to the communicating air opening. In order to facilitate air guide, the first air duct portion 300 further includes an air guide block 350 disposed between the rear cover plate 310 and the middle plate 320 and configured to guide the airflow from the first communicating hole to the communicating air opening, so as to better supply air to the second air duct portion 400. The arrangement of the air guide block 350 facilitates the processing of the first air duct portion 300. In some alternative embodiments, the air guide block 350 may be integrally formed with the middle plate 320, or integrally formed with the rear cover plate 310.

The number of the first air supply ducts is three, including an air supply duct I 314, an air supply duct II 315, and an air supply duct III 316. The air supply duct I 314 is provided with a main air duct connected to the second communicating hole, an upper branch extending upward from a tail end of the main air duct, and a lower branch extending downward from the tail end of the main air duct. The air supply duct II 315 extends downward from the third communicating hole. The air supply duct III 316 extends upward from the fourth communicating hole. The number of the air baffles 521 is three, including a first air baffle, a second air baffle, and a third air baffle disposed in sequence clockwise. The first air baffle is configured to completely shield the first communicating hole. The second air baffle is configured to completely shield the second communicating hole. The third air baffle is configured to completely shield the third communicating hole and the fourth communicating hole.

The plurality of air supply structures may include a first air supply structure 331, a second air supply structure 332, a third air supply structure 333, a fourth air supply structure 334, a fifth air supply structure 335 and a sixth air supply structure 336. The first air supply structure 331 is disposed on a tail end of the upper branch. The second air supply structure 332 is disposed on a middle upper part of the lower branch, and the third air supply structure 333 is disposed on a tail end of the lower branch. The fourth air supply structure 334 may be disposed on a tail end of the air supply duct III 316. The fifth air supply structure 335 is disposed on a middle upper part of the air supply duct II 315, and the sixth air supply structure 336 is disposed on a tail end of the air supply duct II 315.

Further, the first air duct portion 300 may further include an air return structure portion 340 disposed on a lower end of the rear cover plate 310. An air return pipeline is formed on a lower side of the air return structure portion 340.

Hereto, it should be appreciated by those skilled in the art that although a number of exemplary embodiments of the present invention have been shown and described in detail herein, many other variations or modifications in accordance with the principles of the present invention can be directly ascertained or derived from the disclosure of the present invention without departing from the spirit and scope of the present invention. Therefore, the scope of the present invention should be understood and deemed to cover all such other variations or modifications.

The invention claimed is:

1. An air-cooled refrigerator, comprising a cabinet, wherein the cabinet is provided with a cellar compartment, at least one storage compartment, and an air duct assembly communicating the cellar compartment and the at least one storage compartment, wherein the air duct assembly is provided with an accommodating cavity with a rearward air inlet, and a plurality of air supply communicating holes is formed in a peripheral wall of the accommodating cavity; air in the cellar compartment enters the at least one storage compartment via the plurality of air supply communicating holes;

the air-cooled refrigerator further comprises an air door shielding device; the air door shielding device is provided with a shielding part, and the shielding part is provided with a plurality of air baffles; the shielding part is rotatably disposed in the accommodating cavity, so as to have shielding positions for the plurality of air baffles to completely shield all the air supply communicating holes, thus further preventing the air in the cellar compartment from entering the at least one storage compartment via the plurality of air supply communicating holes during the defrosting of the air-cooled refrigerator;

a bottom of a sidewall of the accommodating cavity is provided with a water guide groove inclined rearward and downward, and the air duct assembly is provided with a water outlet hole communicating a rear side of the air duct assembly with a rear end of the water guide groove, so that water in the accommodating cavity flows out of the air duct assembly via the water guide groove and the water outlet hole;

the air door shielding device further comprises:

a base, wherein the shielding part is further provided with a turntable portion rotatably mounted on the base; the plurality of air baffles extends from the turntable portion to a rear side, and is disposed at intervals in a circumferential direction of the turntable portion;

a motor, disposed on a radial outer side of the shielding part, and mounted on the base:

a driving gear, mounted on an output shaft of the motor; and a driven gear, mounted on the turntable portion or integrally formed with the turntable portion, and meshed with the driving gear, wherein the driven gear is a gear ring disposed on a side of the turntable portion facing away from the air baffles;

the base comprises a base plate, a bottom cover, and a first position baffle extending from one side of the base plate;

the turntable portion is mounted on a radial outer side of the first position baffle, and each of the air baffles extends out of the other side of the base plate;

the bottom cover covers the one side of the base plate, an inner side of the bottom cover is provided with a second position baffle and a third position baffle, and the gear ring is disposed on a radial outer side of the second position baffle and a radial inner side of the third position baffle;

the second position baffle is provided with a notch;

the side of the turntable portion facing away from the air baffles is further provided with a bump disposed within the notch to define a rotating range of the turntable portion;

a side of the turntable portion facing the base plate is provided with an annular rib; and a side of an edge of the base plate facing the turntable portion is an inclined surface.

2. The air-cooled refrigerator according to claim 1, wherein the air duct assembly comprises a first air duct portion; and the accommodating cavity is disposed in an upper part of the first air duct portion;

a middle part or a lower part of a rear surface of the first air duct portion are/is recessed forward, and a rear side of the first air duct portion is the cellar compartment; and a front side of the first air duct portion is one or more of the at least one storage compartment.

3. The air-cooled refrigerator according to claim 2, wherein the first air duct portion comprises:

a rear cover plate, wherein the rear cover plate is provided with a back plate and a cavity defining plate extending from the back plate; the air inlet is formed in an upper part of the back plate; the cavity defining plate defines the accommodating cavity, the plurality of air supply communicating holes, and air supply ducts respectively with the plurality of air supply communicating holes, and the air supply ducts comprise at least one first air supply duct;

a middle plate, disposed on a front side of the back plate, and being in contact with and abutted against the cavity defining plate; and a front cover plate, covering the rear cover plate, and having a front plate located on a front side of the middle plate and a plurality of air supply structures formed on the front plate; and the middle plate is arranged such that each of the at least one first air supply duct is communicated with one or more of the air supply structures therethrough.

4. The air-cooled refrigerator according to claim 3, wherein the air duct assembly comprises a second air duct portion, the second air duct portion is located on an upper side of the first air duct portion, and a front side of the second air duct portion is one or more of the at least one storage compartment;

the air supply ducts further comprises a second air supply duct, and an upper surface of the first air duct portion is provided with a communicating air opening communicating the second air supply duct and the second air duct portion.

5. The air-cooled refrigerator according to claim 4, wherein the number of the air supply communicating holes is four, comprising a first communicating hole, a second communicating hole, a third communicating hole, and a fourth communicating hole formed in sequence clockwise; the first communicating hole is formed in an upper right side of the accommodating cavity, and the second communicating hole is formed in a lower right side of the accommodating cavity; the third communicating hole and the fourth communicating hole are connected to each other and formed in a left side of the accommodating cavity;

the second air supply duct extends rearward and upward from the first communicating hole to the communicating air opening;

the number of the at least one first air supply duct is three, comprising an air supply duct I, an air supply duct II, and an air supply duct III;

the air supply duct I is provided with a main air duct connected to the second communicating hole, an upper branch extending upward from a tail end of the main air duct, and a lower branch extending downward from the tail end of the main air duct;

the air supply duct II extends downward from the third communicating hole;

the air supply duct III extends upward from the fourth communicating hole;

the number of the air baffles is three, comprising a first air baffle, a second air baffle, and a third air baffle disposed in sequence clockwise; the first air baffle is configured to completely shield the first communicating hole; the second air baffle is configured to completely shield the second communicating hole; and the third air baffle is configured to completely shield the third communicating hole and the fourth communicating hole.

6. The air-cooled refrigerator according to claim 2, wherein the air door shielding device further comprises a centrifugal wind wheel mounted within the accommodating cavity and configured to draw an airflow from the air inlet and urge the airflow to enter each of the air supply communicating holes in a circumferential direction or radial direction thereof.

7. The air-cooled refrigerator according to claim 6, wherein the centrifugal wind wheel is mounted on the base.

8. The air-cooled refrigerator according to claim 7, wherein the turntable portion is a rotating ring;

the centrifugal wind wheel is mounted on an other side of the base plate; and the bottom cover covers at least the side of the turntable portion facing away from the air baffles.

9. The air-cooled refrigerator according to claim 8, wherein the base further comprises a motor mounting portion and a spanning plate; and the spanning plate comprises:

a first avoiding plate, extending from an edge of the base plate in a direction away from the base plate;

a second avoiding plate, disposed in parallel with the first avoiding plate, and located on a radial outer side of the air baffles; and a connecting plate, connecting the first avoiding plate and the second avoiding plate, and allowing one or more of the air baffles to enter between the first avoiding plate and the second avoiding plate; and the motor mounting portion is disposed on a side of the second avoiding plate back away from the first avoiding plate; the motor is mounted on the motor mounting portion; and the bottom cover further covers the motor mounting portion.

10. The air-cooled refrigerator according to claim 1, wherein the air door shielding device further comprises a centrifugal wind wheel mounted within the accommodating cavity and configured to draw an airflow from the air inlet and urge the airflow to enter each of the air supply communicating holes in a circumferential direction or radial direction thereof.

11. The air-cooled refrigerator according to claim 10, wherein the centrifugal wind wheel is mounted on the base.

12. The air-cooled refrigerator according to claim 11, wherein the turntable portion is a rotating ring;

the centrifugal wind wheel is mounted on an other side of the base plate; and the bottom cover covers at least the side of the turntable portion facing away from the air baffles.

13. The air-cooled refrigerator according to claim 12, wherein the base further comprises a motor mounting portion and a spanning plate; and the spanning plate comprises:

a first avoiding plate, extending from an edge of the base plate in a direction away from the base plate;

a second avoiding plate, disposed in parallel with the first avoiding plate, and located on a radial outer side of the air baffles; and a connecting plate, connecting the first avoiding plate and the second avoiding plate, and allowing one or more of the air baffles to enter between the first avoiding plate and the second avoiding plate; and the motor mounting portion is disposed on a side of the second avoiding plate back away from the first avoiding plate; the motor is mounted on the motor mounting portion; and the bottom cover further covers the motor mounting portion.

* * * * *